US006971524B1

(12) United States Patent
Voswinkel

(10) Patent No.: US 6,971,524 B1
(45) Date of Patent: Dec. 6, 2005

(54) ONE-PIECE GIFT BOX

(76) Inventor: Denise Voswinkel, 3 Dylan Dr., Newtown, CT (US) 06470

( * ) Notice: Subject to any disclaimer, the term of this patent is extended or adjusted under 35 U.S.C. 154(b) by 0 days.

(21) Appl. No.: 10/443,497

(22) Filed: May 22, 2003

Related U.S. Application Data

(60) Provisional application No. 60/393,291, filed on Jul. 2, 2002.

(51) Int. Cl.[7] ..... B65D 5/50

(52) U.S. Cl. ..... 206/762; 206/764; 206/765; 206/767; 206/232

(58) Field of Search ..... 206/738, 739, 206/756, 762, 764, 765, 767, 45.29, 232, 206/486, 588, 590, 784, 806; 229/103, 120.08, 229/120.09, 120.12, 120.15, 120.23, 120.21

(56) References Cited

U.S. PATENT DOCUMENTS

| | | | | | |
|---|---|---|---|---|---|
| 888,774 | A | | 5/1908 | Wood | |
| 1,084,851 | A | | 1/1914 | Ford | |
| 1,352,759 | A | * | 9/1920 | Markert | 206/486 |
| 1,700,432 | A | | 1/1929 | Cahill | |
| 2,008,949 | A | | 7/1935 | Ellsworth | |
| 2,017,176 | A | * | 10/1935 | Andrews | 229/120.21 |
| 2,308,177 | A | | 1/1943 | Jones | |
| 2,611,529 | A | | 9/1952 | Currivan | |
| 2,643,811 | A | | 6/1953 | Bolding | |
| 3,539,089 | A | | 11/1970 | Osberg | |
| 3,853,259 | A | | 12/1974 | Tupper | |
| 4,160,502 | A | * | 7/1979 | Roccaforte | 206/784 |
| 4,394,905 | A | * | 7/1983 | Hackenberg | 206/486 |
| 4,925,088 | A | * | 5/1990 | Ostrander | 229/120.12 |
| 5,076,492 | A | * | 12/1991 | Tupes | 229/120.21 |
| 5,540,330 | A | * | 7/1996 | Lo Duca | 206/590 |
| 5,938,109 | A | * | 8/1999 | Sainz et al. | 229/120.21 |

* cited by examiner

*Primary Examiner*—Luan K. Bui
(74) *Attorney, Agent, or Firm*—Carmody & Torrance LLP

(57) ABSTRACT

A one-piece gift box that includes an angled gift support. Gift restraints are provided for restraining the gift on the gift support. Preferably, the gift is in the shape of a card, such as the shape of a credit card, and is preferably what is known as a giftcard, similar to a gift certificate.

6 Claims, 11 Drawing Sheets

ONE-PIECE GIFT BOX

RELATED TO U.S. APPLICATION DATA

This application claims the benefit of U.S. Provisional Application No. 60/393,291 filed on Jul. 2, 2002.

BACKGROUND OF THE INVENTION

The present invention relates generally to gift boxes, and in particular, to an improved one-piece gift box construction that, among other things, provides for a more particularized and aesthetically pleasing display and presentation of a gift, such as a gift card.

One-piece gift boxes are well-known, examples of which are described in U.S. Pat. Nos. 1,084,851; 2,643,811 and 4,925,088. While these gift boxes may be satisfactory for their intended uses, they all are perceived to be deficient in various respects.

The present inventor has discovered that still further improvements in the art are desirable and has also recognized that such improvements to the state of the art are achievable. In particular, a perceived deficiency in the prior art is the lack of a one-piece gift box having a gift support for displaying a gift, such as a gift card, in which the gift support is part of the material forming the one-piece box. Additionally, it is believed there is a lack of a suitable display methodology (and hence construction to overcome such a deficiency) for such one-piece boxes.

As such, the present invention overcomes the perceived deficiencies in the prior art as well as providing the objectives and advantages set forth above and below.

SUMMARY OF THE INVENTION

Therefore, it is an object and advantage of the present invention to provide an improved one-piece gift box.

It is still a further object and advantage of the present invention to provide an improved one-piece gift box that aesthetically displays gift cards.

It is another object and advantage of the present invention to provide an improved one-piece gift box that is inexpensive to manufacture.

In particular, it is an object of the present invention is to provide a gift support for displaying a gift, such as a gift card, in such a box, in which the gift support is part of the material forming the one-piece box.

Yet another object and advantage of the present invention is to provide an improved construction for displaying a one-piece gift box, and in particular for hangingly displaying such a gift box.

Further objects and advantages of this invention will become more apparent from a consideration of the drawings and ensuing description.

The invention accordingly comprises the features of construction, combination of elements, arrangement of parts and methodology of construction that will be exemplified in the disclosure hereinafter set forth, and the scope of the invention will be indicated in the claims.

To overcome the perceived deficiencies in the prior art and to achieve the objects and advantages above and below, the present invention, generally speaking, is directed to a method of forming a one-piece gift box for a gift that is to be placed therein. In a preferred embodiment, the gift box is formed of a unitary sheet of material comprising (a) a first sidewall having a first edge and a second edge; a second sidewall having a first edge and a second edge, wherein the first edge of the second sidewall is connected to the second edge of the first sidewall at a foldline (a); a third sidewall having a first edge and a second edge, wherein the first edge of the third sidewall is connected to the second edge of the second sidewall at a foldline (b); a fourth sidewall having a first edge and a second edge, wherein the first edge of the fourth sidewall is connected to the second edge of the third sidewall at a foldline (c) and the first sidewall is coupled to the fourth sidewall so as to be able to define a region perimetered by the first, second, third and fourth sidewalls; a top surface having a first edge connected to a top edge of the second sidewall at a foldline (f); (b) an interior shelf structure comprising an inner wall having a first edge and a second edge, wherein the first edge of the inner wall is connected to a top edge of the fourth sidewall at a foldline (e); a gift support, connected to the second edge of the inner wall at a foldline (g); and a gift support supporter connected to the gift support at a foldline; and a collapsible bottom comprising a plurality of bottom surface supports; wherein the method of forming the gift box comprises the steps of constructing the bottom of the gift box and defining a cavity therein; folding the inner wall about foldline (e) towards the cavity so that an inner surface of the inner wall is essentially in facing alignment with an inner surface of the fourth sidewall; folding the gift support along foldline (g), and folding the gift support supporter so that the gift support is positioned in the cavity, the gift support supporter supports the gift support in the cavity, and the gift support is angled downwardly towards the fourth sidewall.

A one-piece construction of a gift box is also provided. In one preferred embodiment, the gift box may have the construction set forth above. In another preferred embodiment, the interior shelf structure of such a box may comprise an interior shelf structure comprising a gift support coupled to a top edge of the fourth sidewall and a gift support supporter connected to the gift support at a foldline, as well as a collapsible bottom comprising a plurality of bottom surface supports that, when formed, defines the cavity. Of course, the interior shelf structure of such a box may also comprise an inner wall having a first edge and a second edge, wherein the first edge of the inner wall is connected to the top edge of the fourth sidewall at a foldline (e); and the gift support is connected to the second edge of the inner wall at a foldline (g); wherein the inner wall is folded about foldline (e) towards the cavity so that an inner surface of the inner wall is essentially in facing alignment with an inner surface of the fourth sidewall; whereby the gift support is angled downwardly towards the fourth sidewall.

In another preferred embodiment, the one-piece gift box may comprise a detachable attachment member, coupled to the gift box, for at least one of blocking a portion of the top surface of the gift box while in its collapsible position and for facilitating hanging of the collapsed gift box on a display hook; wherein the attachment member is detachable from the gift box and forms no part of the structure used to form the gift box. Again, the interior shelf structure and the collapsible bottom may include different constructions, all of which are disclosed herein.

Lastly, the present invention contemplates, discloses and claims a method and construction of a one-piece gift box having an interior shelf structure comprising an inner wall having a first edge and a second edge, wherein the first edge of the inner wall is connected to a top edge of one of the first, third or fourth sidewalls at a foldline. Here, the gift support may extend from any of the sidewalls other than the sidewall from which the top surface of the box extends.

BRIEF DESCRIPTION OF THE DRAWINGS

The above set forth and other features of the invention are made more apparent in the ensuing Description of the Preferred Embodiments when read in conjunction with the attached Drawings, wherein.

Like reference numbers are used for like parts, although not every feature is numbered in each figure.

DETAILED DESCRIPTION OF THE PREFERRED EMBODIMENTS

Reference shall be first made generally to FIGS. 1–8 for a general description of the construction of and method for forming a one-piece gift box in accordance with the present invention, and where appropriate, reference will be made to specific figures for ease of understanding.

Generally speaking, the figures illustrate the construction of a one-piece gift box, generally indicated at 1. Gift box 1 is preferably for a gift that is placed therein, and preferably releasably secured therein.

Although not limited thereto, the gift is preferably what is known as a giftcard, similar to a gift certificate, and usually in the shape of a credit card. However, reference herein to "gift" should not be so limiting, and should be deemed to include any small item that can be placed and/or secured to the gift support in one of the manners disclosed below.

Figure 1:
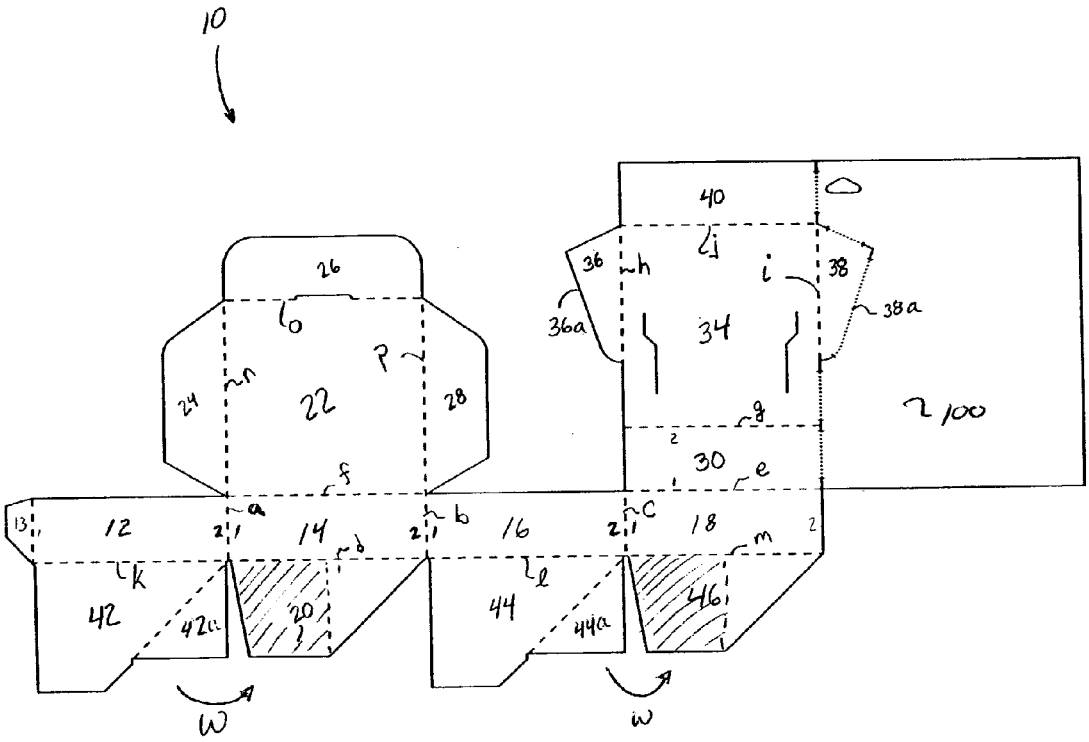
FIGS. 1–8 are perspective views of the present invention in various stages of construction, wherein the section entitled Detailed Description of the Preferred Embodiments makes particular reference to the specific figures for ease of understanding.

Advantageously, the gift box of the present invention is formed of a unitary sheet of material (10). With reference being made to FIG. 1 in particular, a detailed disclosure of all the sections of the material (10) shall first be provided.

Specifically, it can be seen most clearly in FIG. 1 that the unitary sheet of material (10), which will hereinafter be seen to form the gift box (1) preferably comprises a first sidewall (12) having a first edge and a second edge; a second sidewall (14) having a first edge and a second edge, wherein the first edge of the second sidewall is connected to the second edge of the first sidewall at a foldline (a); a third sidewall (16) having a first edge and a second edge, wherein the first edge of the third sidewall is connected to the second edge of the second sidewall at a foldline (b); a fourth sidewall (18) having a first edge and a second edge, wherein the first edge of the fourth sidewall is connected to the second edge of the third sidewall at a foldline (c); and a top surface, generally indicated at (22), having a first edge connected to a top edge of the second sidewall (14) at a foldline (f), wherein the top surface has sidewalls (24, 26, 28) connected to the top surface at respective foldlines (n, o, p).

In accordance with the present invention, an interior shelf structure is provided and is preferably formed by an inner wall (30) having a first edge and a second edge, wherein the first edge of the inner wall is connected to a top edge of the fourth sidewall (18) at a foldline (e); and a gift support (34), connected to the second edge of the inner wall (30) at a foldline (g); a first angled support (36) connected to the gift support (34) at a foldline (h) and having an angled edge (36*a*); a second angled support (38) connected to the gift support (34) at a foldline (i) and having an angled edge (38*a*); and a back support (40) connected to the gift support (34) at a foldline (j).

A bottom to the gift box (1) is preferably formed by a first bottom surface support (20) having a first edge connected to a bottom edge of the second sidewall (14) at a foldline (d); a second bottom surface support (42) connected to the first sidewall (12) at a foldline (k); a third bottom surface support (44) connected to the third sidewall (16) at a foldline (1) and a fourth bottom surface support (46) connected to the fourth sidewall (18) at a foldline (m).

Figure 9:
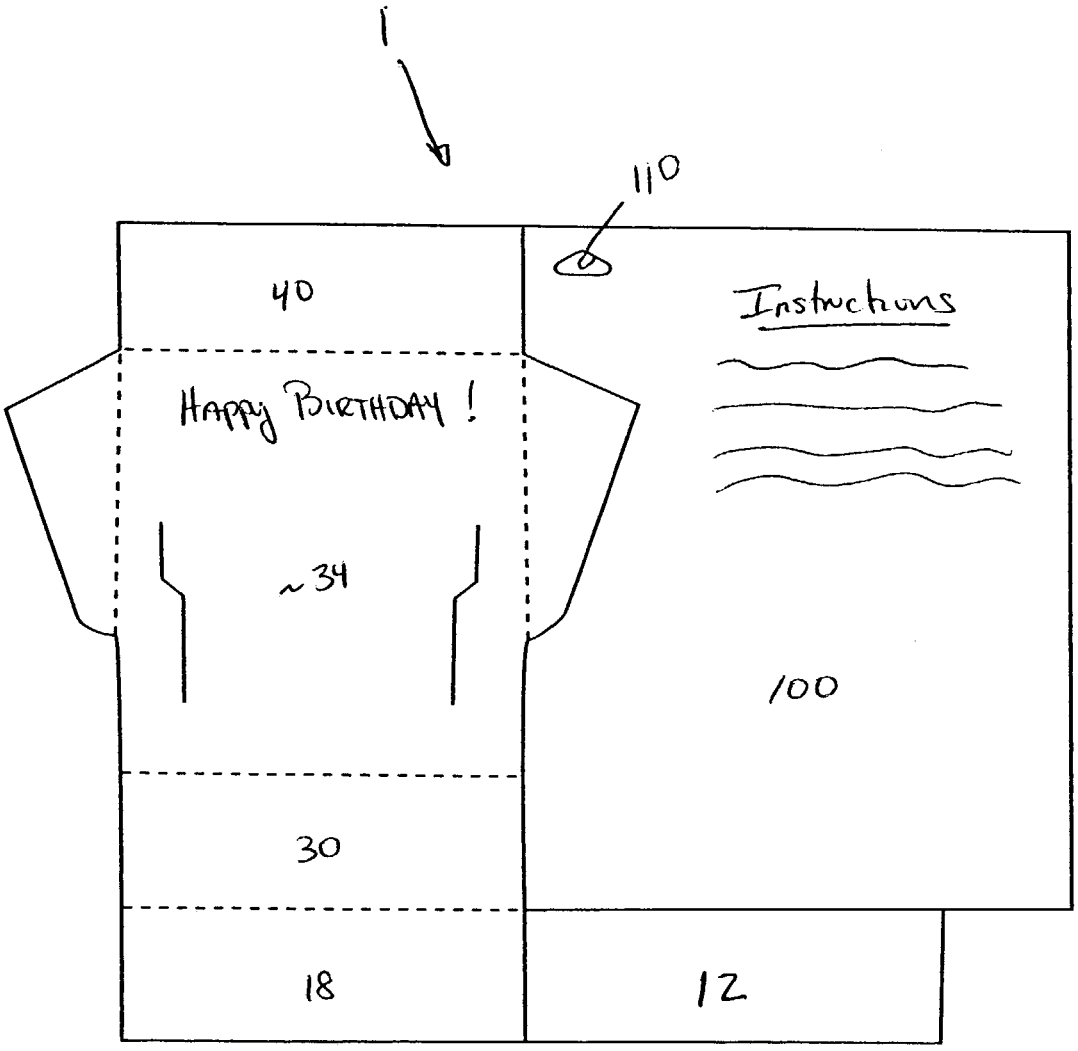
FIG. 9 is a front plan view of the gift box constructed in accordance with the present invention, in both a collapsed and displayable condition.
Figure 10:
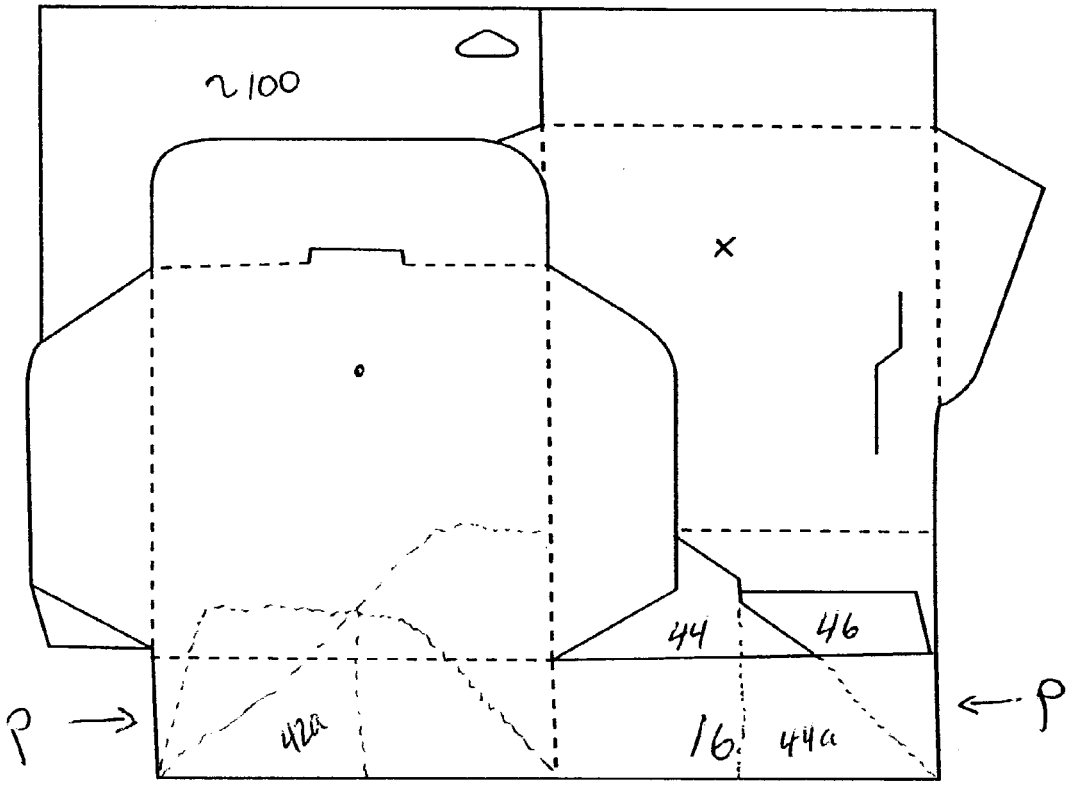
FIG. 10 is a rear view of what is illustrated in FIG. 9.
Figure 11:
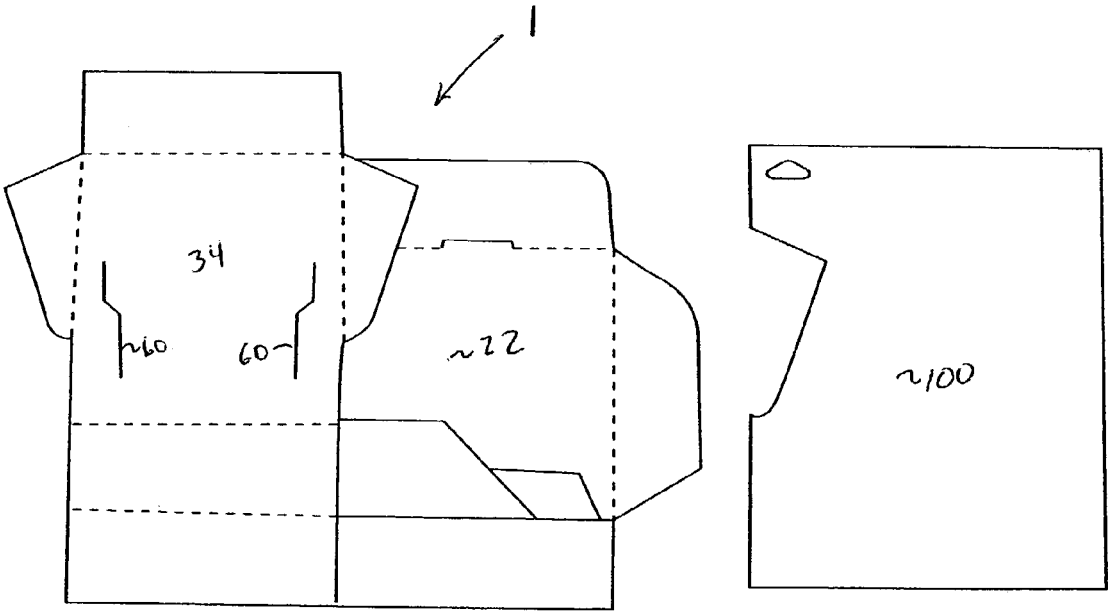
FIG. 11 is the gift box of FIG. 10 with the attachment member removed.

Also shown in FIG. 1 is a tab 13, connected to the first edge of first sidewall (12), its purpose to become clear below. Further, FIG. 1 also illustrates an attaching member (100) which is attached along an edge of back support (40), second angled support (38) and along the edge of gift support (34) and inner wall (30). Preferably, this attaching member (100) has a perforated edge so that it can be easily removed (see FIG. 11). The purpose and advantage of this attaching member (100) will be disclosed further below. As such, FIGS. 9–11 illustrate a gift box made in accordance with the following disclosure.

In a preferred method of construction, gift box (1) is preferably formed by coupling the first sidewall (12) to the fourth sidewall (18) so as to define a region perimetered by the first, second, third and fourth sidewalls (12, 14, 16, 18). This coupling is preferably achieved by the use of tab 13, which is adhered, such as by glue or other adhesive or coupling means, to the inner (or outer if desirable) surface edge of fourth sidewall (18). This is clearly illustrated in FIG. 2.

Figure 2:
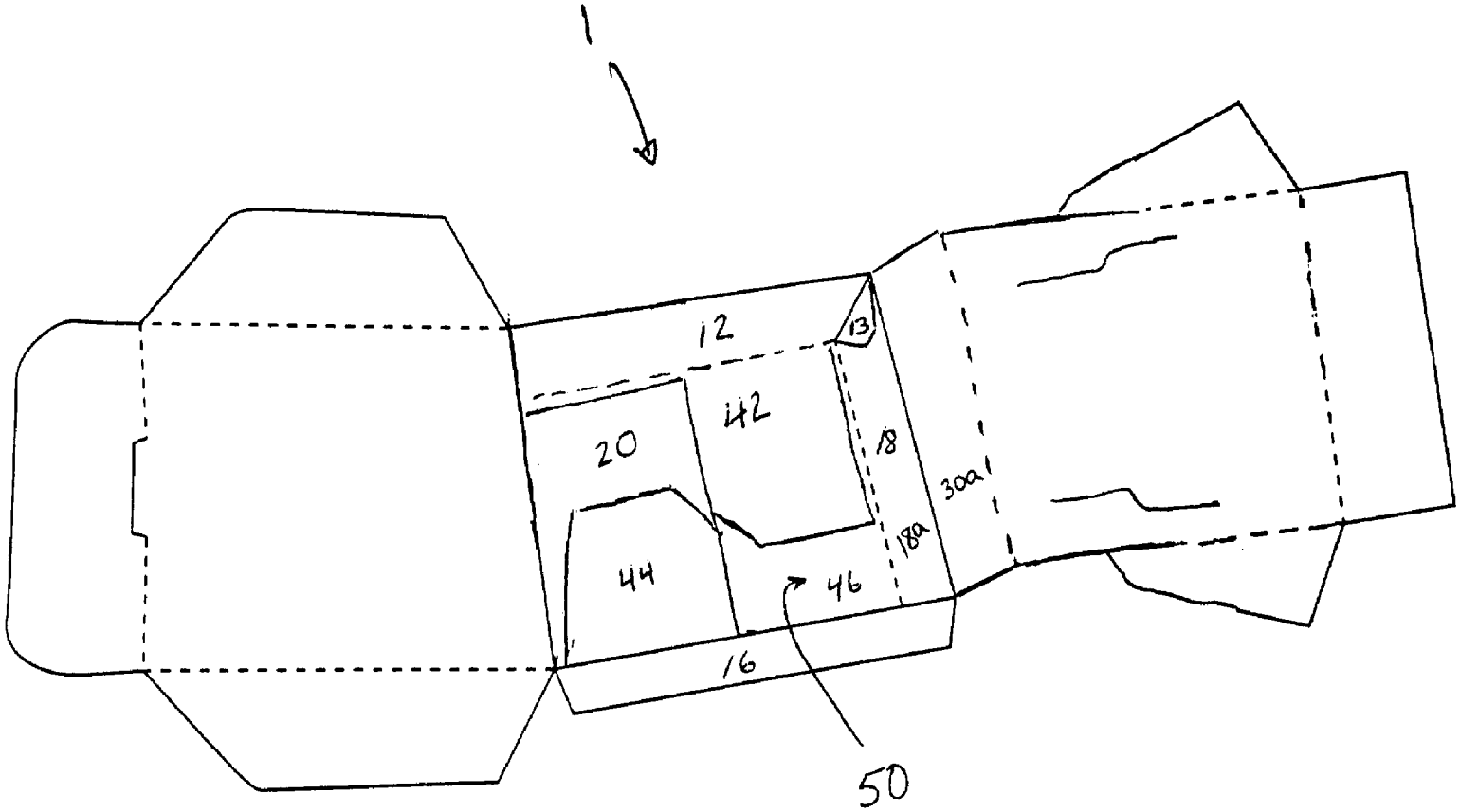
Figure 3:
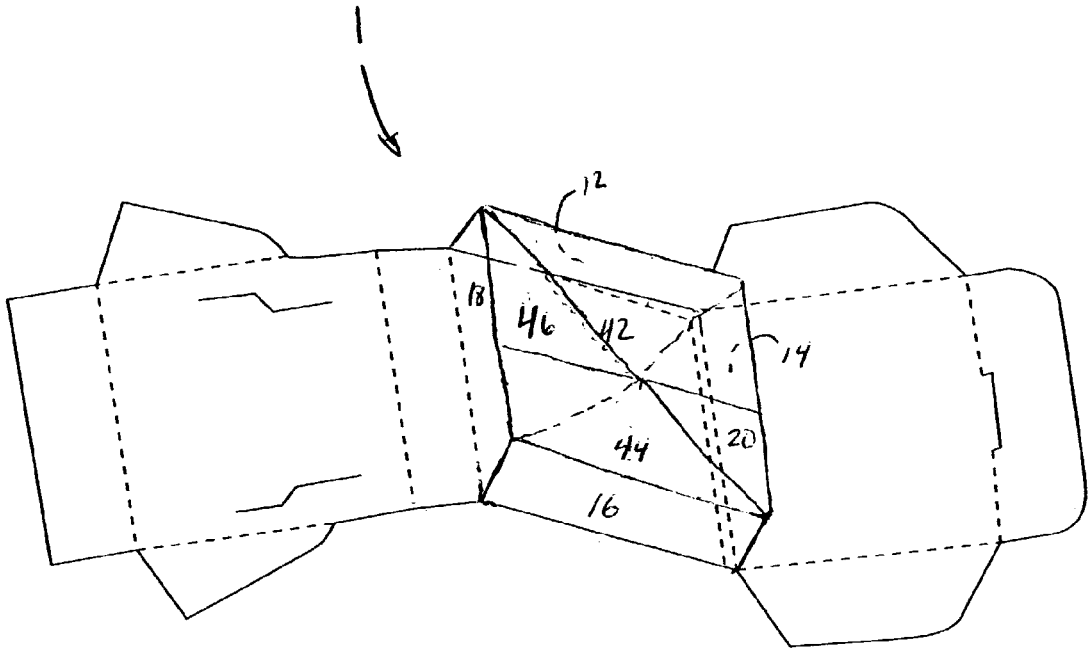

Next, it is preferably to fold the first bottom surface support (20) and the second, third and forth bottom surface supports (42, 44, 46) along their respective foldlines to construct a bottom of the gift box and define a cavity (50) in the gift box. The folding and formation of this bottom of the gift box is also illustrated in FIG. 2 as well as FIG. 3 which illustrates the underside of the bottom of gift box (1). It should however be understood that one may just as easily first fold the first bottom surface support (20) and the second, third and forth bottom surface supports (42, 44, 46) along their respective foldlines, and thereafter couple the first sidewall (12) to the fourth sidewall (18). That is, it should be clear that the order of the steps in constructing the present gift box is not material to the present invention, and the claims should not be viewed as so limiting. This should be understood to be true for any of the steps herein; that is, the order in which they are performed does not matter.

Figure 4:
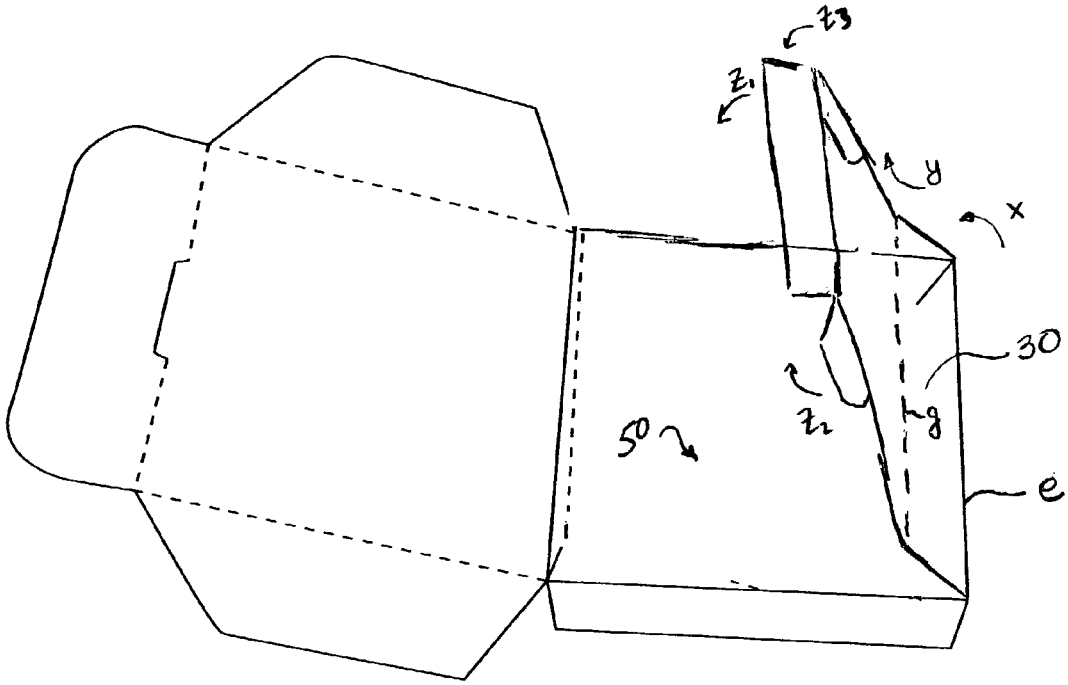
Figure 5:
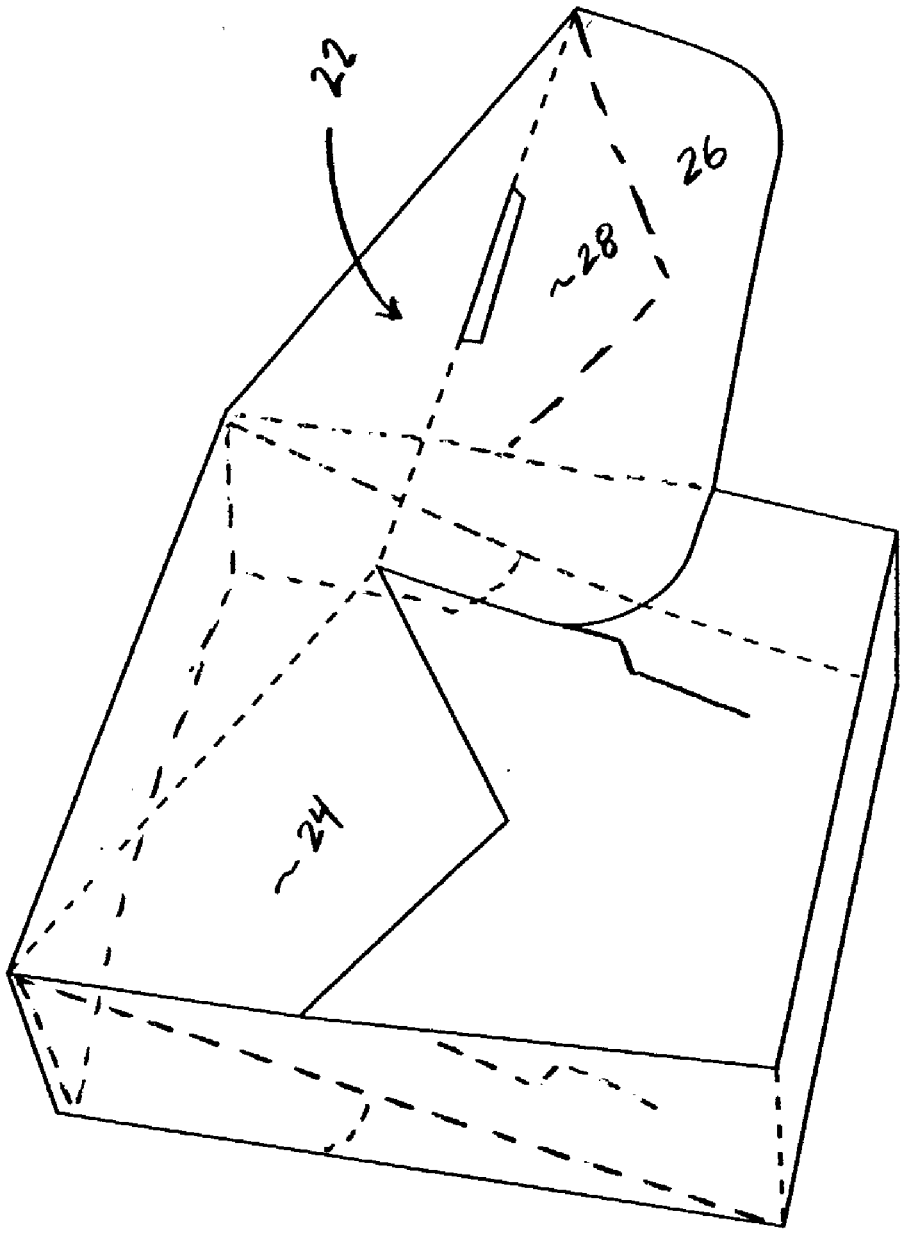

Next, as most clearly illustrated in FIG. 4, it is preferably to fold the inner wall (30) about foldline (e) (i.e. following the rotational direction of arrow "x") towards the cavity (50) so that an inner surface (30*a*, FIG. 2) of the inner wall (30) is essentially in facing alignment with an inner surface (18*a*, FIG. 2) of the fourth sidewall (18), as illustrated in FIG. 5 in its final position.

Next and as also illustrated in FIG. 4, it is preferably to fold the gift support (34) along foldline (g) (i.e. following the rotational direction of arrow "y"), and fold the back support (40) and the first and second angled supports (36, 38) inwardly (see respective arrows $z_1$, $z_2$, $z_3$) so that the gift support (34) is positioned in the cavity and the back support (40), the first angled support (36) and the second angled support (38) support the gift support (34) in the cavity, wherein the gift support is angled downwardly towards the fourth sidewall (18), all as illustrated in FIG. 5.

Figure 6:
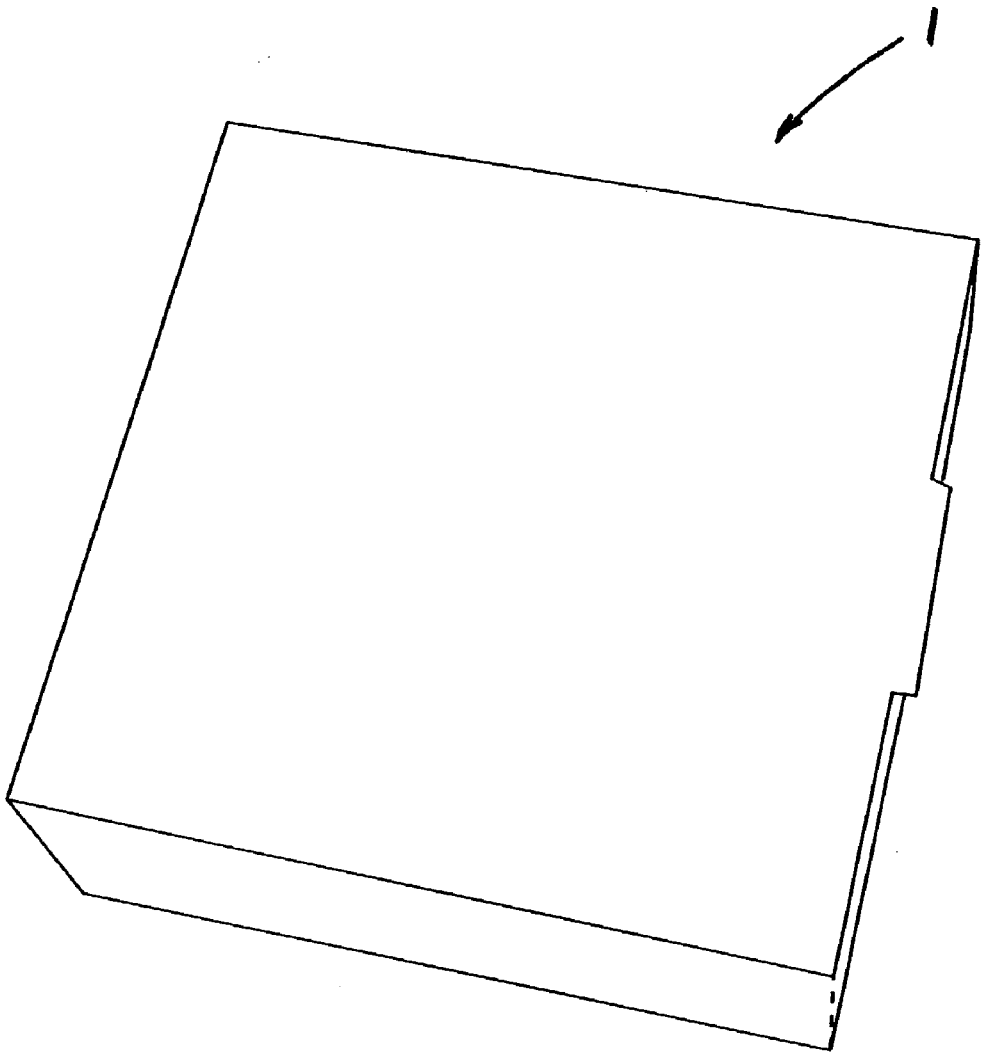
Figure 7:
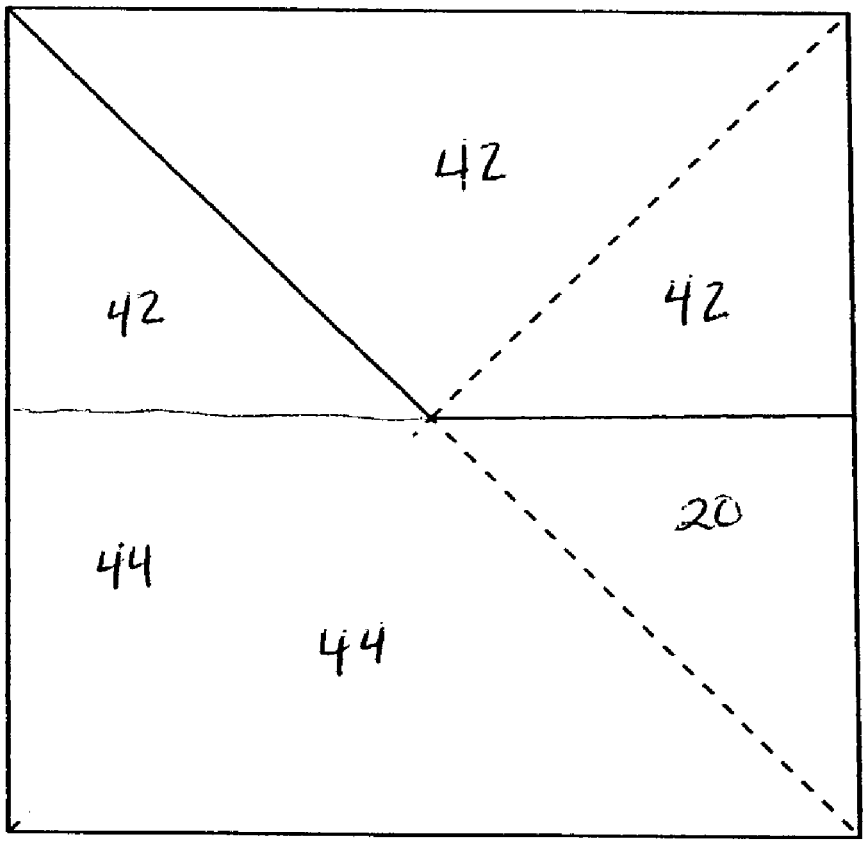

Further steps may include folding the sidewalls (24, 26, 28) of the top surface (22) inwardly (as also illustrated in FIG. 5) and positioning the top surface (22) over the cavity (5), wherein the sidewalls (24, 26, 28) of the top surface (22) assist in friction sealing the top surface (22) against first sidewall (12), third sidewall (16) and fourth sidewall (18) and over the cavity (50). FIG. 6 illustrates a closed gift box (1) from the top, while FIG. 7 illustrates a closed gift box from the bottom.

Gluing or other adhesives can be used as would be understood in the art for connecting the sidewalls or forming the bottom of the gift box (1).

Figure 8:
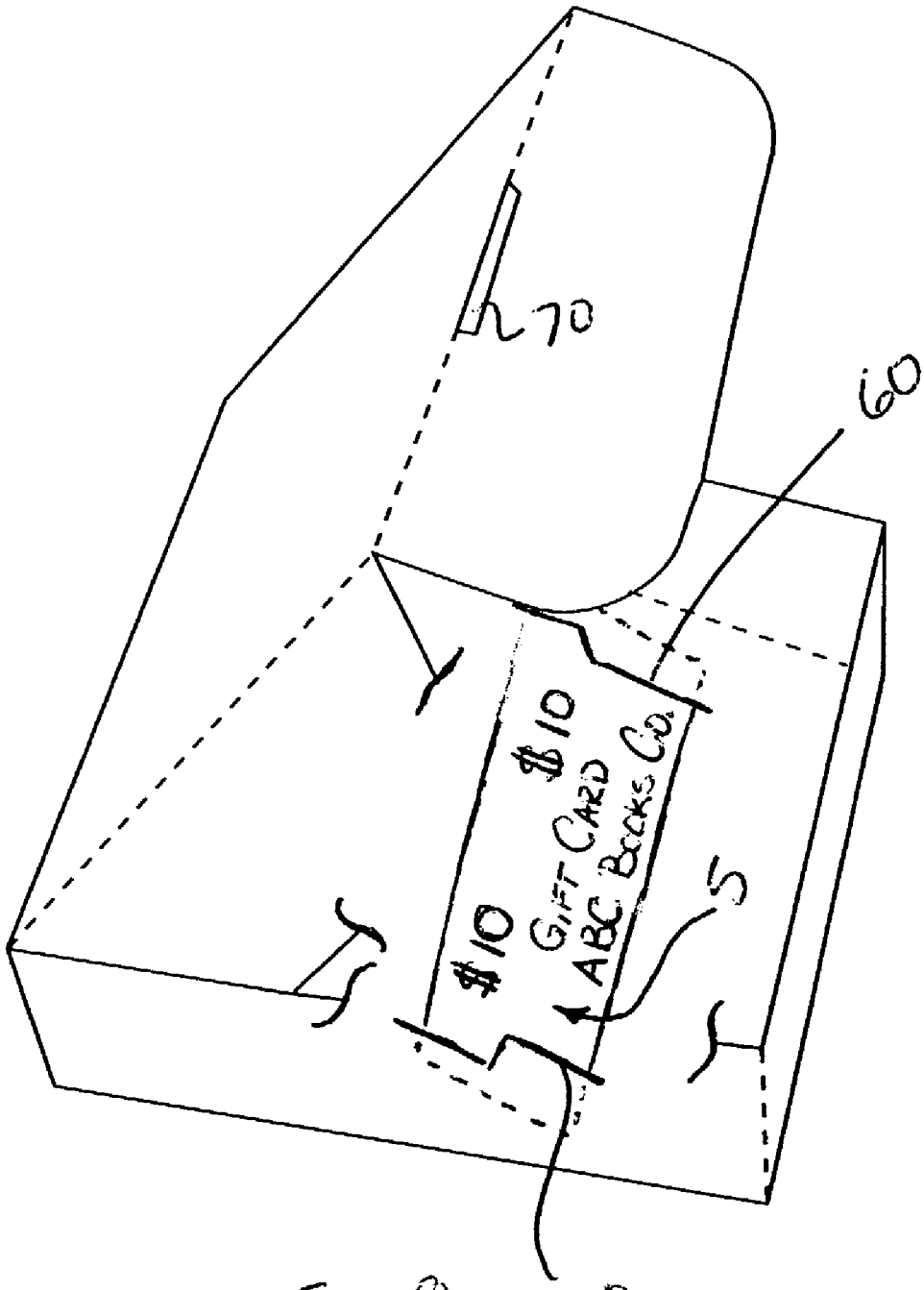

Gift restraints are provided to restrain the gift, generally indicated at 5, on the gift support. In a preferred embodiment, the gift restraints are opposing slits 60 (FIG. 8) in the gift support, although the gift restraints may be opposing bands secured to the gift support, such as by knotting ends thereof through holes formed in the gift support. FIG. 8 illustrates an exemplary gift card being a $10 card redeemable at ABC Books Co. Obviously, this is by way of example and not limitation, as many (or any) other types of gift cards and gift certificates, by way of example, can be provided. Small toys or other displayable gifts are also contemplated and covered by the present claims.

To present the giftbox, it is preferable that gift (5) is provided in the gift box (1) and positioning on the gift support and retrained by the gift restraints, such as the slits.

A small opening, or slot 70, may be provided to assist in opening the gift box.

Importantly, and as stated above, certain changes in the ordering of the steps or construction may be made while staying within the scope of the invention. As yet another example, FIGS. 2, 3 and 7 all illustrate the bottom of the box being "layered" by bottom surface supports (20, 42, 44, 46) in a particular configuration. However, one skilled in the art would readily see that other layering configurations may be made, all while staying within the scope of the present invention.

Reference is once again made to FIG. 1, in combination now with FIGS. 9–11, for a disclosure of a second aspect of the present invention. Specifically, as one not familiar with the construction of such one-piece gift boxes, it is desirable to provide the end user (i.e. selling at the retail level) with as fully completed box as possible. This makes the sale of the gift box easier, and makes the purchase and forming of the gift box a pleasurable experience.

As such, it is desirable to preassemble the box to the extent practical prior to sale or distribution or otherwise disposal of the gift box to the end user. FIGS. 9–10 illustrate the preferred preassembly state of the box to be provided to the end user, with FIG. 9 specifically illustrating the gift box from a front view and FIG. 10 specifically illustrating the gift box in its preferred preassembly condition from the rear.

One skilled in the art would readily be able to understand that getting the layout of material 10 in its FIG. 1 condition to that of FIGS. 9–10 is achieved by (i) rotating second bottom support surface (42) on top of (and adhering to, such as by glue or the like) first bottom support surface (20) as illustrated by arrow "w" (FIG. 1), and thus covering the shaded portion thereof and (ii) rotating third bottom support surface (44) on top of (and adhering to, such as by glue or the like) fourth bottom support surface (46) as also illustrated by arrow "w", and thus covering the shaded portion thereof. The dotted foldline dissecting bottom support surface (42) and bottom support surface (44) permit the collapsing of the preassembled giftbox into the state illustrated by FIGS. 9–10. Also, tab 13 is adhered to fourth sidewall (18) as set forth above.

FIG. 9 most clearly illustrates how the use of attaching member 100 provides a means for hanging and displaying gift box (1), such as in a retail environment.

Specifically, attaching member preferably includes an opening 110 so that gift box (1) can be hung on a hook. However, attaching member (100) provides yet second and third second functions, namely, providing a region on which instructions or other informational indicia (such as price tags, etc) can be printed or otherwise provided and providing for a more aesthetically pleasing display since attaching member (100) can be seen (i.e. compare FIG. 9 to FIG. 11) to block many of the foldlines and portions of the material (10) that comprise and form gift box (1). Accordingly, a much more aesthetically pleasing display of the gift box can be provided, whether the gift box (1) is hung up on a hook or laid flat in a pile.

As illustrated in FIGS. 9–11, attaching member (100) is preferably attached along a perforated edge of back support (40), second angled support (38) and along a perforated edge of gift support (34) and inner wall (30). Preferably, this attaching member (100) has a perforated edge so that it can be easily detached and discarded. Also, the integrity of the edges of back support (40), second angled support (38) and along the edge of gift support (34) and inner wall (30) are thus maintained after such detachment.

Preferably, after attaching member (100) is removed from the remainder of material (10), such as after the purchase thereof, the end user may gently but firmly push on the edges of the box in the direction as shown by arrows "p" in FIG. 10 while also pushing on the inner surface of gift support (34) and/or pulling on the top surface 22 (the "x" and "•" in FIG. 10 are intended to identify the pushing and pulling directions, respectively). Thereafter, the box is completed in accordance with the disclosure set forth above.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention described herein and all statements of the scope of the invention which as a matter of language might fall therebetween. For example, the gift restraint may be opposing bands secured to the gift support. Such bands may be elastic and attached to the gift support by glue or threading the ends through holes in the gift support and knotting the ends on the backside of the gift support. Other equivalent gift restraint are contemplated hereby.

In summary, it can be seen that both methods of forming one-piece gift box (1) and a gift box constructed thereby are provided. To be clear, it should be understood that the present invention, including the claims, covers alternative embodiments contemplated herein. For example, in a preferred embodiment, the interior shelf structure comprises an inner wall (30) having a first edge and a second edge, wherein the first edge of the inner wall is connected to a top edge of the fourth sidewall (18) at a foldline (e); a gift support (34), connected to the second edge of the inner wall (30) at a foldline (g); and a gift support supporter connected to the gift support (34) at a foldline. However, the claims and the specification also cover an interior shelf structure comprising a gift support (34) coupled to a top edge of the fourth sidewall (18) and a gift support supporter connected to the gift support (34) at a foldline. Similarly, the particular configuration of the bottom of the box is not material to the present invention, and as such, the claims recite both the general construction and steps of forming a collapsible bottom, along with claims reciting particular features thereof.

Moreover, another feature of the present invention is the incorporation of a detachable attachment member (100), coupled to the gift box, for at least one of blocking a portion of the top surface (22) of the gift box while in its collapsible position and for facilitating hanging of the collapsed gift box on a display hook, wherein the attachment member is detachable from the gift box and forms no part of the structure used to form the gift box. Since this is one of the patentable features of the present invention, the particulars of the interior shelf structure and the collapsible bottom are not material to the invention, although they are recited in the dependent claims.

Lastly, one skilled in the art would readily appreciate that the one-piece gift box and the methods of forming it is both operable and enabled by the present specification in which the inner wall of the interior shelf structure is connected to a top edge of one of the first, third or fourth sidewalls at a foldline; and a gift support, connected to the second edge of the inner wall at a foldline (g); a gift support supporter connected to the gift support at a foldline; and a bottom formed from a plurality of bottom surface supports; wherein the method of forming the gift box comprises, among other steps, folding the inner wall about the foldline which connects the inner wall to one of the first, second or fourth sidewalls towards the cavity so that an inner surface of the inner wall is essentially in facing alignment with an inner surface of the sidewall to which it is connected; folding the gift support along foldline (g), and folding the gift support supporter so that the gift support is positioned in the cavity and the gift support supporter supports the gift support in the cavity, wherein the gift support is angled downwardly towards the sidewall opposite to the sidewall to which the inner wall is connected. Here, it should be clear that the gift support may extend from any of the sidewalls other than the sidewall from which the top surface (22) extends.

As set forth above, certain changes may be made without departing from the scope of the present invention. For example, the bottom of the box may be made from different configurations. As such the method of formation and the box itself is not constrained to anyone configuration, and the claims should not be limited thereby. For example, the method may merely include of forming of the bottom from a plurality of bottom surface supports and defining a cavity in the gift box. Likewise, the particular construction of the bottom of the one-piece gift box should not be so limiting.

Lastly, it is also contemplated that a horizonally mounted gift support as part of the interior shelf structure claimed in claim 7, may also extend from a top edge of any of the first, third or fourth sidewalls instead of just the fourth sidewall (i.e. opposte the top surface). The method for forming such a box is also contemplated hereby.

What is claimed is:

1. A one-piece gift box that is displayable in a collapsed position at a point of sale, wherein the gift box is formed of a unitary sheet of material comprising (a) a first sidewall having a first edge and a second edge; a second sidewall having a first edge and a second edge, wherein the first edge of the second sidewall is coupled to the second edge of the first sidewall at a first foldline; a third sidewall having a first edge and a second edge, wherein the first edge of the third sidewall is connected to the second edge of the second sidewall at a second foldline; a fourth sidewall having a first edge and a second edge, wherein the first edge of the fourth sidewall is connected to the second edge of the third sidewall at a third foldline and the first sidewall is coupled to the fourth sidewall so as to define a region perimetered by the first, second, third and fourth sidewalls; a top surface having a first edge connected to a top edge of the second sidewall at a fourth foldline; (b) an interior shelf structure comprising a gift support coupled to a top edge of the fourth sidewall and a gift support supporter connected to the gift support at a foldline; and (c) a collapsible bottom comprising a plurality of bottom surface supports; further comprising:

a detachable attachment member, coupled to the gift box, for at least one of blocking a portion of the top surface of the gift box while in its collapsible position and for facilitating hanging of the collapsed gift box on a display hook;

wherein the attachment member is detachable from the gift box and forms no part of the structure used to form the gift box.

2. The one-piece gift box as claimed in claim 1, wherein the one-piece gift box is formed by:

constructing the bottom of the gift box from the plurality of bottom surface supports and defining a cavity in the gift box;

folding the gift support towards the cavity and folding the gift support supporter so that the gift support is positioned in the cavity and supported therein.

3. The one-piece gift box as claimed in claim 1, wherein the interior shelf structure comprises an inner wall having a first edge and a second edge, wherein the first edge of the inner wall is connected to the lop edge of the fourth sidewall at a fifth foldline; and the gift support is connected to the second edge of the inner wall at a sixth foldline; and the one-piece gift box is formed by:

constructing the bottom of the gift box from the plurality of bottom surface supports and defining a cavity in the gift box;

folding the inner wall about fifth foldline towards the cavity so that an inner surface of the inner wall is essentially in facing alignment with an inner surface of the fourth sidewall;

folding the gift support in the direction of the cavity and folding the gift support supporter so that the gift support is positioned in the cavity and supported therein, wherein the gift support is angled downwardly towards the fourth sidewall.

4. The one-piece gift box as claimed in claim 1, wherein the collapsible bottom comprises a bottom surface support having a first edge connected to a bottom edge of the second sidewall at a seventh foldline; a second bottom surface support connected to the first sidewall at an eighth foldline; a third bottom surface support connected to the third sidewall at a ninth foldline and a fourth bottom surface support connected to the fourth sidewall at a tenth foldline.

5. The one-piece gift box as claimed in claim 1, including a gift restraint to restrain a gift on the gift support.

6. The one-piece gift box as claimed in claim 1, wherein the attaching member has a perforated edge, and is detacheably coupled to at least the gift support.

* * * * *